US005174396A

United States Patent [19]

Taylor et al.

[11] Patent Number: 5,174,396

[45] Date of Patent: Dec. 29, 1992

[54] CUTTER ASSEMBLIES FOR ROTARY DRILL BITS

[76] Inventors: Malcolm R. Taylor, 94 Gambier Parry Gardens, Gloucester; Joseph A. Gasan, Solway, 10 Upper Church Road, Stroud, Gloucestershire, both of England

[21] Appl. No.: 265,018

[22] Filed: Oct. 31, 1988

[30] Foreign Application Priority Data

Nov. 3, 1987 [GB] United Kingdom ..... 8725669

[51] Int. Cl.[5] ..... E21B 10/46

[52] U.S. Cl. ..... 175/420.1; 175/413

[58] Field of Search ..... 175/410, 412, 413; 76/108 A

[56] References Cited

U.S. PATENT DOCUMENTS

| | | | |
|---|---|---|---|
| 884,150 | 4/1908 | Hardsoog . | |
| 2,097,030 | 10/1937 | Killgore . | |
| 3,143,177 | 8/1964 | Galorneau et al. | 175/413 |
| 4,073,354 | 2/1978 | Rowley et al. . | |
| 4,109,737 | 8/1978 | Bovenkerk . | |
| 4,200,159 | 4/1980 | Peschel et al. . | |
| 4,397,363 | 8/1983 | Fuller . | |
| 4,453,775 | 6/1984 | Clemmow | 175/410 X |
| 4,529,048 | 7/1985 | Hall . | |
| 4,570,725 | 2/1986 | Matthias et al. | 175/410 X |
| 4,655,508 | 4/1987 | Tomlinson . | |
| 4,724,913 | 2/1988 | Morris | 175/410 X |
| 4,781,256 | 11/1988 | Wardley | 175/410 X |
| 4,782,903 | 11/1988 | Strange | 175/410 |

FOREIGN PATENT DOCUMENTS

| | | |
|---|---|---|
| 2056381 | 5/1972 | Fed. Rep. of Germany . |
| 2849711 | 6/1979 | Fed. Rep. of Germany . |
| 391259 | 7/1973 | U.S.S.R. . |
| 582399 | 11/1977 | U.S.S.R. . |

OTHER PUBLICATIONS

MEGAdiamond brochure dated Oct. 6, 1981, four pages. "MEGAdiamond Announces a Unique Service".

*Primary Examiner*—William P. Neuder

*Attorney, Agent, or Firm*—Browning, Bushman, Anderson & Brookhart

[57] ABSTRACT

A cutter assembly for a rotary drill bit comprises an elongate stud to be received in a socket in the surface of the bit body, the stud having mounted at one end thereof a preform cutting element. At least a major part of the stud is generally in the form of a cylinder of a circular cross-section having two symmetrically disposed flats extending longitudinally thereof, the flats being inclined towards the longitudinal axis of the stud as they extend towards the end of the stud remote from the cutting element. The flats allow the cutter assemblies to be packed together more closely side-by-side across a convexly curved surface of the body of the drill bit.

8 Claims, 2 Drawing Sheets

CUTTER ASSEMBLIES FOR ROTARY DRILL BITS

BACKGROUND OF THE INVENTION

The invention relates to cutter assemblies for rotary drill bits for use in drilling or coring deep holes in subsurface formations.

The cutting assemblies are for use in rotary drill bits of the kind comprising a bit body having a shank for connection to a drill string, a plurality of cutter assemblies mounted at the surface of the bit body, and a passage in the bit body for supplying drilling fluid to the surface of the bit for cleaning and/or cooling the cutters.

Each cutter assembly comprises an elongate stud which is received in a socket in the surface of the bit body, the stud having mounted at one end thereof at least one preform cutting element. The preform cutting element may be of the kind comprising a tablet, often circular or part-circular, having a thin hard cutting layer of polycrystalline diamond bonded to a thicker, less hard backing layer, for example of tungsten carbide. However, preform cutting elements are also known which consist of a unitary body of thermally stable polycrystalline diamond.

The studs of this kind of cutting assembly are often in the form of a cylinder of circular cross-section. Studs of this form have the advantage that their simple geometry facilitates the formation of appropriate sockets in the bit body, whether such sockets are formed by machining in a steel bodied bit, or by mounting suitably shaped formers in the mould in the case where the bit body is formed from solid infiltrated matrix in a powder metallurgy process. In each case the simple cylindrical form of the required sockets not only means that they can be manufactured at low cost, but it also facilitates the dimensioning of the sockets so as to control, for example, the braze gap between each stud and its socket in cases where the stud is to be secured in the socket by brazing.

Cylindrical sockets of circular cross-section, however, have the disadvantage that the stud can adopt any rotational position in the socket. This means that it is then necessary to ensure that each stud is correctly rotationally orientated in its socket before it is secured in position. However, the loads to which a cutting assembly is subjected during drilling may often result in the application of a substantial torque to the stud and it is therefore sometimes found that such studs become rotationally displaced in their sockets in the course of use.

Furthermore, in order to provide adequate strength to the mounting of the cutter assemblies in the bit body, it is necessary to provide a certain minimum thickness of solid material between adjacent sockets along the whole of their lengths. Since rows of cutting assemblies are often disposed side by side along convexly curved portions of the bit body, the inner ends of the sockets are closer together than the outer ends and, consequently, it may often not be possible to arrange the cutting elements, on the projecting outer ends of the posts, as close together as is desirable.

Attempts have been made to overcome these problems by the use of studs which are non-circular in cross-section. For example, studs which are of generally rectangular or similar cross-section may be packed together more closely in the bit body than studs of circular cross-section and the orientation of the socket automatically fixes the orientation of the stud inserted in it. However, the corresponding non-circular sockets are difficult and costly to manufacture with the required accuracy. The present invention sets out to provide a new form of cutter assembly where the above mentioned problems are reduced and yet where the studs and corresponding sockets may still be manufactured to the required degree of accuracy at a comparatively low cost.

SUMMARY OF THE INVENTION

According to the invention there is provided a cutter assembly for a rotary drill bit, comprising an elongate stud to be received in a socket in the surface of the bit body, the stud having mounted at one end thereof at least one preform cutting element, at least a major part of the stud being generally in the form of a cylinder of circular cross-section having at least one flat extending longitudinally thereof, the flat being inclined towards the longitudinal axis of the stud as it extends towards the end of the stud remote from the cutting element.

Since the stud is simply in the form of a circular cross-section cylinder formed with a flat it is convenient to manufacture to the required tolerances and the corresponding socket may also be readily manufactured. The provision of the flat, however, provides the desirable orientation of the cutting assembly in the socket and the inclination of the flat to the longitudinal axis of the stud means that the stud reduces in width as it extends inwardly. Consequently the cutting assemblies may be packed together more closely side-by-side across a convexly curved surface of the bit body.

Preferably the end of the flat nearer the cutting element intersects the cylindrical peripheral surface of the stud.

Preferably there are provided two similar flats on the stud. For example, the flats may be symmetrically disposed on opposite sides of the central longitudinal axis of the stud. In the case where two such symmetrical flats are provided, they are preferably also symmetrically disposed with respect to the cutting element.

The preform cutting element may be mounted on a surface of the elongate stud, at said one end thereof, which is inclined at an angle of less than 90° to the longitudinal axis of the stud.

The materials and other characteristics of the stud and cutting element may be of any of the kinds well known in the art. For example, the cutting element may comprise a front cutting face of polycrystalline diamond or other superhard material bonded to a backing layer of less hard material, such as tungsten carbide, the backing layer being bonded to said inclined plane surface of the stud. Alternatively the cutting element may be formed from thermally stable polycrystalline diamond.

The stud itself may be formed, for example, from tungsten carbide or from steel.

The cutting element may have a cutting edge which is substantially straight or has a large radius of curvature, for example of 100 mm or greater.

The invention also includes within its scope a rotary drill bit comprising a bit body formed over the surface thereof with a plurality of sockets, there being mounted within each socket a cutter assembly comprising a stud, one end portion of the stud being received and secured within the socket and an opposite end portion of the stud projecting from the socket, said projecting portion of the stud having mounted thereon at least one preform cutting element, at least a major part of the stud being generally in the form of a cylinder of circular cross-section having at least one flat extending longitudinally thereof, the flat being inclined towards the longitudinal axis of the stud as it extends towards the end of the stud remote from the cutting element, and the socket in the bit body being of corresponding shape, that is to say of generally circular cross-section cylindrical form having at least one plane surface extending longitudinally thereof the plane surface within the socket being inclined at a similar angle and being of similar dimensions to the flat on the stud so as to be engaged by said flat when the stud is received in the socket.

DETAILED DESCRIPTION OF THE PREFERRED EMBODIMENT

Figure 1:
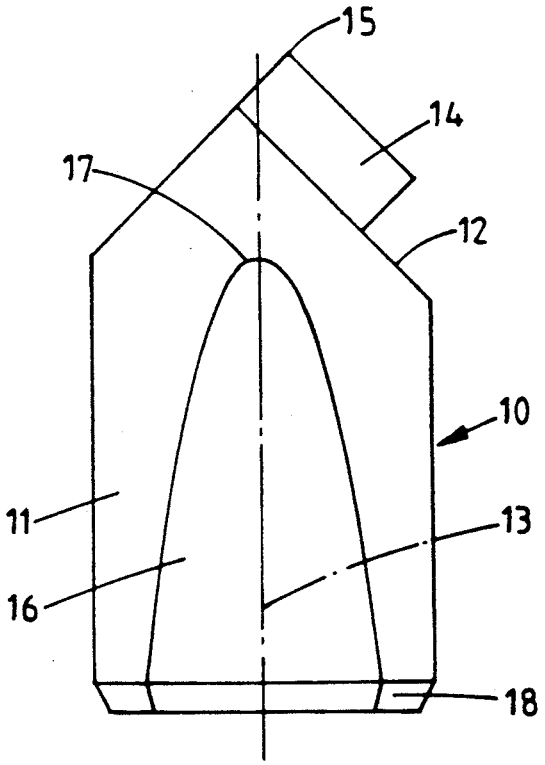
FIG. 1 is a side elevation of a cutter assembly in accordance with the invention.

Referring to FIG. 1, the cutter assembly 10 comprises a generally cylindrical stud 11, formed for example from tungsten carbide, which is formed adjacent one end thereof with an inclined plane surface 12 which is disposed at an angle of less than 90° to the longitudinal axis 13 of the stud. In the example shown the plane surface 12 is inclined at 45° to the longitudinal axis of the stud.

Figure 2:
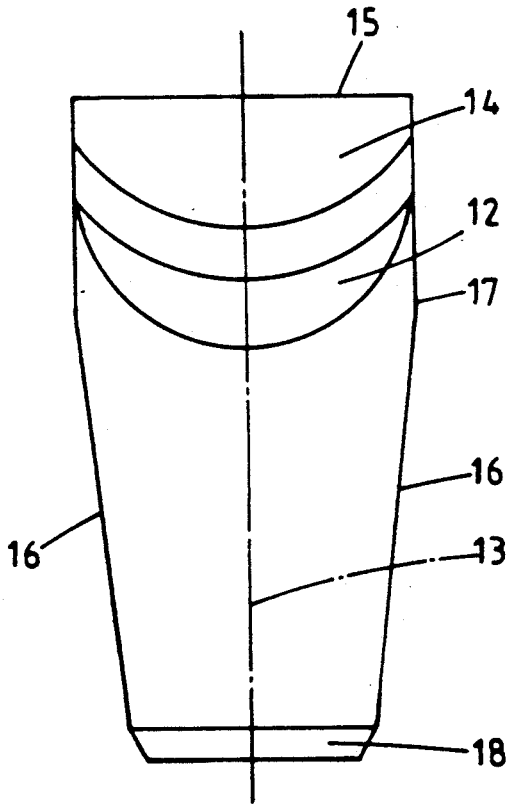
FIG. 2 is a front elevation of the assembly shown in FIG. 1.

Mounted on the inclined surface 12 is a preform cutting element 14. As best seen in FIG. 2, the cutting element is generally part-circular in form and has a cutting edge 15 which may be straight, as shown, but which may also be of a radius of curvature substantially greater than that of the rest of the cutting element. For example the cutting element may be approximately 23 mm in width and the cutting edge 15 may have a radius of curvature of the order of 100 mm or greater. The corners of the cutting element, at opposite ends of the cutting edge, may be radiused, typically of 5–10 mm radius.

Symmetrically disposed on opposite sides of the stud 11 are two flats 16. The flats, as best seen in FIG. 2, are inclined towards the longitudinal axis 13 of the stud as they extend towards the end of the stud remote from the cutting element 14, and the ends of the flats nearer the cutting elements intersect the cylindrical surface of the stud as indicated at 17.

The end of the stud remote from the cutting element 14 is peripherally chamfered as indicated at 18.

The cutting element 14 may be a two-layer cutting element comprising a cutting layer of polycrystalline diamond bonded to a thicker backing layer of tungsten carbide. Alternatively, the element may be a unitary body of thermally stable polycrystalline diamond.

Figure 3:
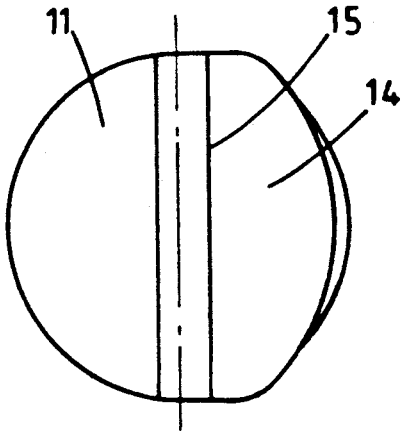
FIG. 3 is an end elevation of the cutter assembly.
Figure 4:
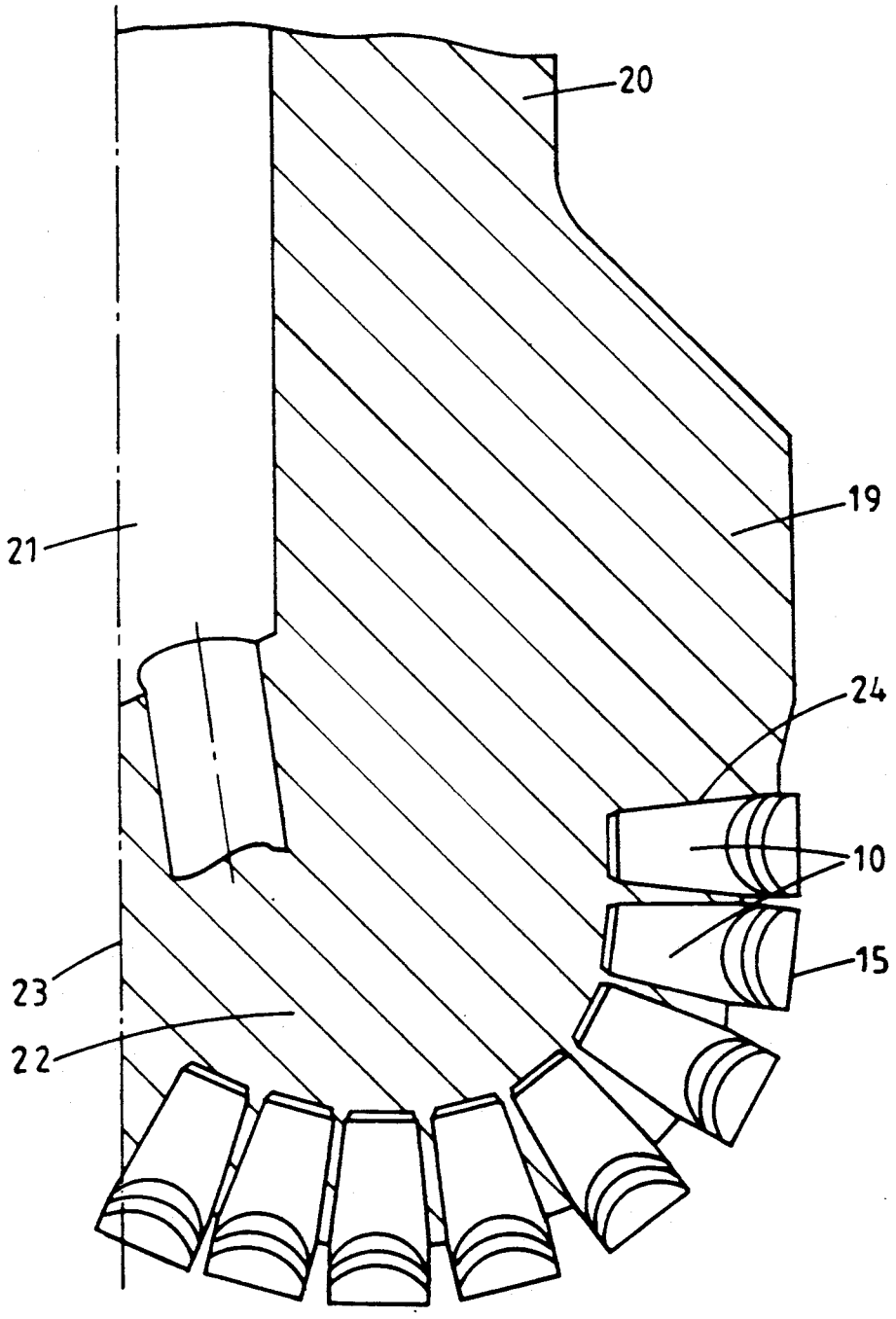
FIG. 4 is a half-section through a drill bit incorporating a plurality of cutter assemblies in accordance with the invention.

FIG. 4 shows a half-section through a bit body 19 on which are mounted a plurality of cutter assemblies of the kind shown in FIGS. 1 to 3. The bit body 19 has a shank 20 for connection to a drill string and a central passage 21 for supplying drilling fluid to nozzles in the surface of the bit body for cleaning and/or cooling the cutter assemblies. The details of the design and construction of such drill bits are well known and will not therefore be described or illustrated in detail.

The bit body is formed with a number of blades 22 extending generally radially outwardly from the central axis 23 of the bit. For example there may typically be four such blades, only one of which is illustrated in FIG. 4.

Spaced apart along each blade, which is convexly curved, are a plurality of cutter assemblies 10 of the kind previously described. The stud 11 of each cutter assembly is received within a correspondingly shaped socket 24 formed in the bit body. Each socket is generally cylindrical but is formed with two symmetrically opposed plane surfaces inclined at an angle to the central axis of the socket, the angle of inclination being the same as the angle of inclination of the flats on the studs so that the flats engage the plane surfaces within the socket when the studs are inserted.

It will be seen from FIG. 4 that an inclined flat 16 on each cutter assembly faces an inclined flat on an adjacent assembly and this enables the assemblies to be packed more closely along the blade 22 than would be the case if the studs and sockets were entirely cylindrical. Also, the provision of the flats and corresponding surfaces within the sockets fixes the orientation of the cutter assemblies and also ensures that the assemblies cannot be rotated in their sockets by forces applied to them in the course of drilling. Cutter assemblies of the kind illustrated, where the cutting edge 15 is substantially straight or of large radius of curvature, are particularly susceptible to rotation during drilling since drilling forces at the corners of the cutting elements may apply a substantial torque to the assemblies.

The bit body may be formed from steel or other machinable metal, in which case the sockets may be formed by machining. Where the bit body is formed by a powder metallurgy process, the sockets may be formed in conventional manner by mounting suitably shaped formers within the mould before it is packed with the matrix-forming powder.

We claim:

1. A rotary drill bit comprising a bit body formed over the surface thereof with a plurality of blind sockets, there being mounted within each socket a cutter assembly comprising a stud, one end portion of the stud being received and secured within the socket and an opposite end portion of the stud projecting from the socket, the stud having lateral socket-engaging surfaces surrounded by and affixed to lateral surfaces of the socket, said projecting portion of the stud having mounted thereon at least one preform cutting element, at least a major part of the stud being generally in the form of a cylinder of circular cross section having at least one flat extending longitudinally thereof, the flat being inclined toward the longitudinal axis of the stud as it extends toward said one end so that a lateral dimension of the stud decreases from an outer end of the flat to an inner end of the flat, and the socket in the bit body being of corresponding shape, that is to say of generally circular cross section cylindrical form having at least one plane surface extending longitudinally thereof, the plane surface within the socket being inclined at a similar angle and being of similar dimensions to the flat on the stud so as to be engaged by said flat when the stud is received in the socket, the plurality of cutter assemblies including at least one row of assemblies spaced apart side-by-side along a convexly curved portion of the surface of the bit body, said at least one inclined flat on each cutter assembly in the row facing an adjacent cutter assembly and at least two adjacent cutter assemblies in the row being inclined toward one another as they extend into the bit body, said at least two adjacent cutter assemblies being so close together that, if the studs of said cutter assemblies were wholly cylindrical, and were not provided with said at least one inclined flat, the studs would interfere with each other along said lateral socket-engaging surfaces.

2. A rotary drill bit according to claim 1, wherein the end of the flat nearer the cutting element on each stud intersects the cylindrical peripheral surface of the stud.

3. A rotary drill bit according to claim 1, wherein there are provided two similar flats on each stud.

4. A rotary drill bit according to claim 3, wherein the flats on each stud are symmetrically disposed on opposite sides of the central longitudinal axis of the stud.

5. A rotary drill bit according to claim 4, wherein the flats on each stud are also symmetrically disposed with respect to the cutting element.

6. A rotary drill bit according to claim 1, wherein each preform cutting element is mounted on a surface of the elongate stud, at least one end thereof, which is inclined at an angle of less than 90° to the longitudinal axis of the stud.

7. A rotary drill bit according to claim 1, wherein each cutting element has a cutting edge which is substantially straight.

8. A rotary drill bit according to claim 1, wherein each cutting element has a cutting edge having a radius of curvature of at least 100 mm.

* * * * *